US010049567B2

(12) United States Patent
Asai et al.

(10) Patent No.: US 10,049,567 B2
(45) Date of Patent: Aug. 14, 2018

(54) TRAFFIC FLOW RATE CALCULATION METHOD AND DEVICE

(71) Applicant: FUJITSU LIMITED, Kawasaki-shi, Kanagawa (JP)

(72) Inventors: Tatsuya Asai, Kawasaki (JP); Junichi Shigezumi, Kawasaki (JP); Hiroya Inakoshi, Tama (JP)

(73) Assignee: FUJITSU LIMITED, Kawasaki (JP)

( * ) Notice: Subject to any disclaimer, the term of this patent is extended or adjusted under 35 U.S.C. 154(b) by 0 days.

(21) Appl. No.: 15/407,475

(22) Filed: Jan. 17, 2017

(65) Prior Publication Data

US 2017/0206782 A1 Jul. 20, 2017

(30) Foreign Application Priority Data

Jan. 20, 2016 (JP) ..... 2016-009081

(51) Int. Cl.
*G08G 1/01* (2006.01)

(52) U.S. Cl.
CPC ..... *G08G 1/0141* (2013.01); *G08G 1/0112* (2013.01); *G08G 1/0116* (2013.01); *G08G 1/0133* (2013.01); *G08G 1/012* (2013.01)

(58) Field of Classification Search
CPC .. G08G 1/0141; G08G 1/0112; G08G 1/0116; G08G 1/0133
See application file for complete search history.

(56) References Cited

U.S. PATENT DOCUMENTS 6,490,519 B1 * 12/2002 Lapidot ..... G01C 21/34 340/905

FOREIGN PATENT DOCUMENTS

| | | | |
|---|---|---|---|
| JP | 2001-148094 | A | 5/2001 |
| JP | 2003-203289 | A | 7/2003 |
| JP | 2004-29871 | A | 1/2004 |
| JP | 2012-79197 | A | 4/2012 |

OTHER PUBLICATIONS

Extended European Search Report dated Jul. 7, 2017, issued in counterpart European Application No. 17151367.4. (8 pages).
Umetani et al., "Estimation of Movement History of People based on the Observation Information", CSIS DAYS 2014 Research Abstracts, pp. 26, 2014.

* cited by examiner

*Primary Examiner* — Basil T Jos
(74) *Attorney, Agent, or Firm* — Westerman, Hattori, Daniels & Adrian, LLP

(57) ABSTRACT

A traffic flow rate calculation method includes, by using a road network produced by representing a road system with a plurality of nodes and a plurality of edges including a stationary sensor edge in which a stationary sensor measures the number of moving bodies; obtaining the first number of observations corresponding to the number of trajectories measured by mobile sensors for each path, the each path including the at least one edge, the each of trajectories corresponding to a movement trajectory of the moving body, and the second number of observations corresponding to the number of moving bodies measured by the stationary sensor; estimating an observation rate by using the first number of observations and the second number of observations; calculating a traffic flow rate for the each path by using the estimated observation rate and the first number of observations for each path.

14 Claims, 10 Drawing Sheets

FIG. 2

31

| TRAJECTORY ID | OBSERVATION POINT ID | x-COORDINATE | y-COORDINATE | OBSERVATION TIME |
|---|---|---|---|---|
| $\alpha_1$ | $P_{11}$ | $x_{11}$ | $y_{11}$ | $s_{11}$ |
| $\alpha_1$ | $P_{12}$ | $x_{12}$ | $y_{12}$ | $s_{12}$ |
| ... | | | | |

FIG. 3

32

| SENSOR ID | x-COORDINATE | y-COORDINATE | THE NUMBER OF OBSERVATIONS | | |
|---|---|---|---|---|---|
| | | | PERIOD 1 | PERIOD 2 | ... |
| STATIONARY SENSOR 1 | $x_{F1}$ | $y_{F1}$ | 6 | 5 | |
| STATIONARY SENSOR 2 | $x_{F2}$ | $y_{F2}$ | 24 | 21 | |
| ... | | | | | |

FIG. 4

33

| NODE INFORMATION | | | EDGE INFORMATION | |
|---|---|---|---|---|
| NODE ID | x-COORDINATE | y-COORDINATE | EDGE ID | CONNECTED NODES |
| $N_1$ | $x_{N1}$ | $y_{N1}$ | $e_1$ | $N_1_N_3$ |
| $N_2$ | $x_{N2}$ | $y_{N2}$ | $e_2$ | $N_2_N_3$ |
| $N_3$ | $x_{N3}$ | $y_{N3}$ | $e_3$ | $N_3_N_4$ |
| ... | | | ... | |

| EDGE ID | THE NUMBER OF OBSERVATIONS BY STATIONARY SENSOR |
|---|---|
| $e_1$ | 6 |
| $e_3$ | 24 |

| PATH ID | PATH | THE NUMBER OF OBSERVATIONS |
|---|---|---|
| $T_1$ | $e_1$, $e_2$ | 2 |
| $T_2$ | $e_2$, $e_3$ | 1 |
| $T_3$ | $e_3$, $e_4$ | 4 |
| $T_4$ | $e_3$, $e_5$ | 6 |

TRAFFIC FLOW RATE CALCULATION METHOD AND DEVICE

CROSS-REFERENCE TO RELATED APPLICATION

This application is based upon and claims the benefit of priority of the prior Japanese Patent Application No. 2016-009081, filed on Jan. 20, 2016, the entire contents of which are incorporated herein by reference.

FIELD

The embodiments discussed herein are related to a traffic flow rate calculation method and a traffic flow rate calculation device.

BACKGROUND

An estimation of a traffic situation, such as a traffic volume, or the like of people, vehicles, or the like on a road, a track, a facility, or the like is being made. The estimation is performed using sensor data that was observed by sensors capable of observing information regarding movement of moving bodies, such as people, vehicles, or the like. An example of the sensor is a global positioning system (GPS) capable of observing the movement trajectory of a moving body. Other examples of the sensor is a road sensor for the system under the trademark "Vehicle Information and Communication System" (VICS) that is capable of observing the number of moving bodies that pass through a fixed location, and a ticket gate that supports a traffic system IC card.

One of proposed technologies for estimating a traffic situation is a technique for estimating a traveling time in each link on a road network by using the traffic information obtained by the information from road sensors and traffic information transmitted from a running vehicle. In this technique, the estimated value of the traveling time is $\alpha$ times the average speed of a vehicle in each link when information from a running vehicle is obtained. In this regard, $\alpha$ is the actual distance of a road section represented by a link length or a link. Also, the estimated value of the traveling time is a times the average speed of a vehicle in each link when information is obtained from a road sensor. Further, in a link where both the information from a running vehicle and the information from a road sensor are obtained, the estimated value of the traveling time is the weighted sum of the estimated value calculated based on the information from a running vehicle and the estimated value calculated based on the information from a road sensor.

Also, there is proposed a method for solving an integer programming problem under the constraint condition which is the traffic flow rate observed by each sensor located at each site. In the method, a variable is the traffic flow rate for each path on a time-space network obtained by expanding a network representing a traffic system in the time axis. In this method, the traffic flow rate is obtained for a path having actual passage results of people in the past.

As patent literature, a related-art technique is disclosed in Japanese Laid-open Patent Publication No. 2004-29871.

As nonpatent literature, a related-art technique is disclosed in Shunnji UMETANI, Tooru KUMANO, Takashi HASUIKE, Hiroshi MORITA, "Estimation of movement history of people based on observation information", CSIS DAYS 2014 Research Abstracts, 2014, pp. 26.

SUMMARY

According to an aspect of the invention, a traffic flow rate calculation method includes, by using a road network produced by representing a road system with a plurality of nodes and a plurality of edges, the road system including a stationary sensor for measuring the number of moving bodies, the plurality of edges including a stationary sensor edge corresponding a road including the stationary sensor, obtaining, by a processor, the first number of observations and the second number of observations, the first number of observations being the number of trajectories measured by mobile sensors for each path, the each path including the at least one edge, the each of trajectories corresponding to a movement trajectory of the moving body, the second number of observations being the number of moving bodies measured by the stationary sensor for the each of the stationary sensor edges; estimating an observation rate represented by a ratio of the first number of observations to an actual traffic flow rate of the path for the each path by using the first number of observations and the second number of observations; calculating a traffic flow rate for the each path by using the estimated observation rate for the each path and the first number of observations for each path.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

BRIEF DESCRIPTION OF DRAWINGS

FIG. 2 is a diagram illustrating an example of mobile sensor data;

FIG. 3 is a diagram illustrating an example of stationary sensor data;

FIG. 4 is a diagram illustrating an example of a data structure a path graph;

DESCRIPTION OF EMBODIMENTS

When the traffic flow rate of moving bodies at each point is estimated as a traffic situation, it is possible for a sensor capable of observing a movement trajectory of a moving body (hereinafter also referred to as a "mobile sensor"), such as a GPS, or the like to partially observe the traffic flow rate at each point. However, just summing of observation information by the mobile sensors may give the traffic flow rate regarding limited moving bodies such as people having a smartphone with a specific application installed thereon, a vehicle in which a car navigation system having a specific function is installed or the like.

On the other hand, with a road sensor for VICS™, or a sensor, such as a ticket gate that supports a traffic system IC card, or the like, it is possible to correctly observe the traffic flow rate at a part of the points. The road sensor and the sensor provided in ticket gate are hereinafter referred to as a "stationary sensor". That is to say, on a road, a facility, or the like on which a stationary sensor is installed, it is possible to correctly know the actual traffic flow rate. However, it is impossible to know the traffic flow rate of the other places at all.

A consideration will be described on the case in which the traffic flow rate is estimated by applying the traffic information transmitted from both of the road sensors and the running vehicles to the related art technique for estimation of the travelling time. In this case, the observation rate by a mobile sensor in each edge or link is equal to the value given by dividing the traffic flow rate observed by mobile sensors by the actual traffic flow rate. This observation rate is equivalent to a in the related art technique. In the related art, a is the actual distance of a road section indicated by an edge length or an edge, and is a known value. When the observation rate in each edge is assumed to be a, the actual traffic flow rate of an each edge is unknown, and thus it is not possible to correctly obtain the observation rate $\alpha$ of each edge.

Also, in the related art technique in which the traffic flow rate observed by sensors disposed at individual points is used as a constraint, it is difficult to calculate the traffic flow rate with high precision when the ratio of the edges at which the traffic flow rate is observable by stationary sensors is low.

According to an embodiment of the present disclosure, it is desirable to improve the calculation precision of the traffic flow rate.

In the following, a detailed description will be given of an example of an embodiment according to the present disclosure with reference to the drawings.

Figure 1:
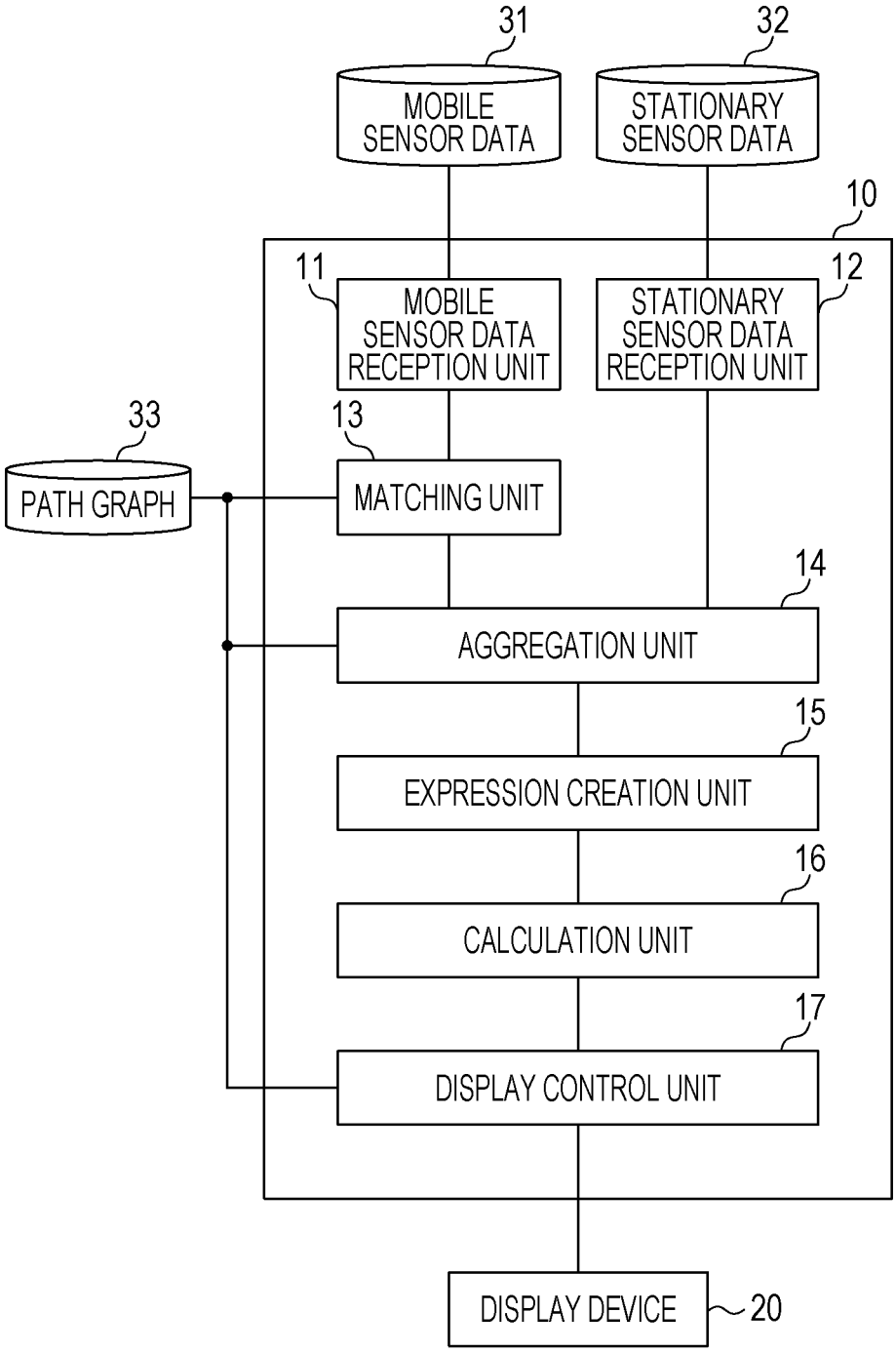
FIG. 1 is a functional block diagram illustrating a schematic configuration of a traffic flow rate calculation device according to the present embodiment.

As illustrated in FIG. 1, a traffic flow rate calculation device 10 according to the present embodiment receives input of mobile sensor data 31 and stationary sensor data 32, calculates the traffic flow rate for each path in a path graph 33, and displays the calculation result on the display device 20.

The mobile sensor data 31 is data observed by a sensor (hereinafter referred to as a "mobile sensor"), such as a global positioning system (GPS) capable of observing the movement trajectory of a moving body, such as a person, a vehicle, or the like. The mobile sensor data 31 is trajectory data represented by an observation data sequence that indicates the position of the moving body observed by the mobile sensor at predetermined time intervals.

The observation data observed by the mobile sensor includes a sensor ID for identifying a mobile sensor, positional data (x-coordinate and y-coordinate) of a moving body, which is indicated by a latitude and a longitude for each observation point, and observation time. The trajectory data (the mobile sensor data 31) is produced by extracting a plurality of pieces of observation data for each sensor ID, and arranging positional data for each observation point included in each observation data in time series based on the observation time. In this regard, even when trajectory data has the same data sensor ID, when the difference in observation time between observation points is a predetermined time period or more, the trajectory data is divided at that position. In this case, a trajectory ID that is uniquely identifiable of trajectory data is given to each trajectory data by adding a serial number to a sensor ID, or the like. In the following, the trajectory data having a trajectory ID of $\alpha_i$ is denoted by "trajectory data $\alpha_i$", and the trajectory represented by trajectory data $\alpha_i$ is also denoted by "trajectory $\alpha_i$".

For example, it is assumed that the observation points included in trajectory data $\alpha_i$ are $P_{i1}, P_{i2}, \ldots, P_{ij}, \ldots P_{iJ}$ (J is the number of observation points included in the trajectory data $\alpha_i$). In this case, it is possible to express the trajectory data $\alpha_i$ by $\alpha_i=\{P_{i1}, P_{i2}, \ldots, P_{ij}, \ldots, P_{iJ}\}$. Also, the observation data indicating each observation point includes a trajectory ID of the trajectory data including the observation point, an observation point ID which is the identification information of the observation point, positional data (x-coordinate and y-coordinate), and observation time. For example, it is possible to express the observation data of the observation point $P_{ij}$ included in the trajectory data $\alpha_i$ by $P_{ij}=\{\alpha_i, P_{ij}, (x_{ij}, y_{ij}), s_{ij}\}$. In this regard, $(x_{ij}, y_{ij})$ is the positional data of the observation point $P_{ij}$, and $s_{ij}$ is the observation time of the observation point $P_{ij}$. FIG. 2 illustrates an example in which the trajectory data (the mobile sensor data 31) is expressed by a data structure in a table form.

The stationary sensor data 32 is data observed by a sensor (hereinafter referred to as a "stationary sensor") that is disposed at a predetermined location and is capable of observing the correct number of moving bodies that pass the location. The stationary sensor is, for example, a road sensor for the system under the trademark Vehicle Information and Communication System (VICS), a ticket gate that supports a traffic system IC card, or the like.

FIG. 3 illustrates an example of the stationary sensor data 32 expressed by a data structure in a table form. In the example in FIG. 3, the stationary sensor data 32 includes a "sensor ID" which is identification information of the stationary sensor, and positional data ("x-coordinate" and "y-coordinate") indicating the location where the stationary sensor is disposed. Also, the stationary sensor data 32 includes an item of "the number of observations" of the moving body observed by the stationary sensor at predetermined time intervals.

The path graph 33 is an example of a road network produced by expressing a road traffic system by a plurality of nodes each of which represents positional information, and a plurality of edges that connect the nodes. FIG. 4 illustrates an example in which the path graph 33 is expressed by a data structure in a table form. In the example in FIG. 4, the path graph 33 is represented by a set of node information indicating the nodes included in the path graph 33, and a set of edge information indicating edges. The node information includes, for example, identification information (the node ID) of each node, and the positional data (x-coordinate and y-coordinate) of each node. Also, the edge information includes the identification information (the edge ID) of each edge, and connected node information that is expressed by the notation of the node IDs of the nodes connected by the edge using an "_ (underscore)". Hereinafter, an edge having an edge ID of $e_i$ is also denoted by an "edge $e_i$".

In this regard, the path graph 33 may be stored in a predetermined storage area of the traffic flow rate calculation device 10, or may be stored in an external storage device coupled to the traffic flow rate calculation device 10, or in a storage medium, such as a CD-ROM, a USB memory, or the like.

As illustrated in FIG. 1, the traffic flow rate calculation device 10 includes a mobile sensor data reception unit 11, a stationary sensor data reception unit 12, a matching unit 13, an aggregation unit 14, an expression creation unit 15, a calculation unit 16, and a display control unit 17. In this regard, the mobile sensor data reception unit 11, the stationary sensor data reception unit 12, the matching unit 13, and the aggregation unit 14 are examples of the acquisition unit according to the present embodiment. Also, the expression creation unit 15 and the calculation unit 16 are examples of the estimation unit and the calculation unit of the present embodiment respectively.

The mobile sensor data reception unit 11 receives the mobile sensor data 31, and transfers the received mobile sensor data 31 to the matching unit 13.

The stationary sensor data reception unit 12 receives the stationary sensor data 32, and transfers the received stationary sensor data 32 to the aggregation unit 14.

Figures 5, 6:
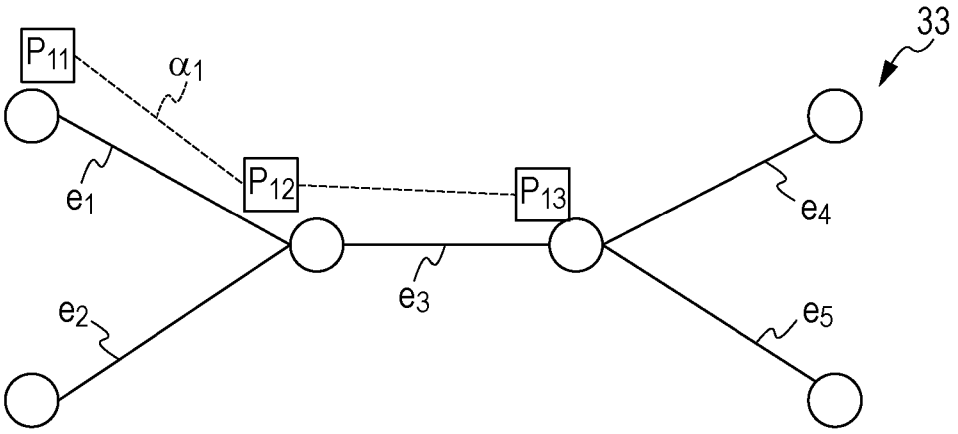
FIG. 5 is a diagram for explaining matching of mobile sensor data with a path graph.
FIG. 6 is a diagram illustrating an example of total results of the number of observations of moving bodies by stationary sensors.

The matching unit 13 reads the path graph 33, performs matching of the trajectory indicated by each mobile sensor data 31 with the path graph 33, and calculates the path corresponding to the trajectory. For example, as illustrated in FIG. 5, the matching unit 13 performs matching of the path graph 33 including edges $e_1$, $e_2$, $e_3$, $e_4$, and $e_5$ with the trajectory $\alpha_1$ including observation points $P_{11}$, $P_{12}$, and $P_{13}$ so as to calculate a path ($e_1$, $e_3$) that corresponds to the trajectory $\alpha_i$. The matching unit 13 transfers the information of the path calculated for each of the mobile sensor data 31 to the aggregation unit 14.

Based on the stationary sensor data 32 transferred from the stationary sensor data reception unit 12, the aggregation unit 14 identifies an edge corresponding to the location where the stationary sensor is disposed, the edge being hereinafter referred to as a "stationary sensor edge", among the edges included in the path graph 33. It is possible for the aggregation unit 14 to identify the stationary sensor edge based on the positional data included in the stationary sensor data 32, for example. Also, the edge ID of the stationary sensor edge corresponding to the stationary sensor may be included in the stationary sensor data in advance. As illustrated in FIG. 6, the aggregation unit 14 stores the edge ID of the identified stationary sensor edge and the number of observations of moving bodies observed by the stationary sensor corresponding to the stationary sensor edge.

Figures 7, 8:
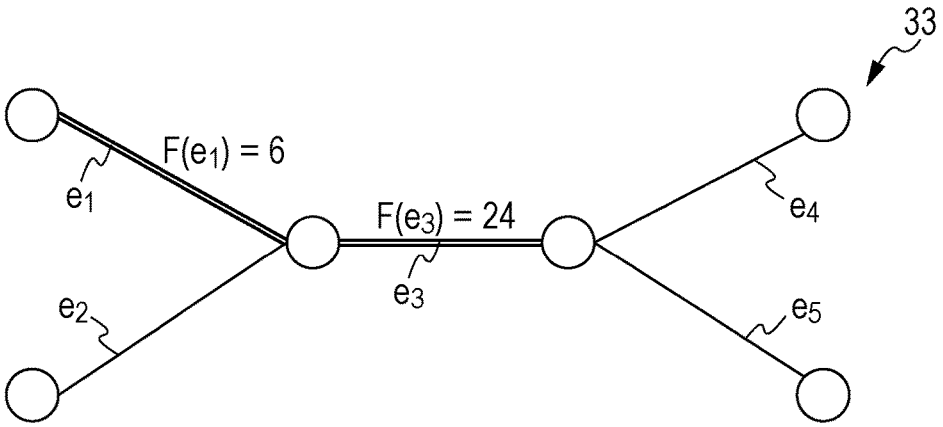
FIG. 7 is a diagram illustrating an example of total results of the number of observations of moving bodies by stationary sensors.
FIG. 8 is a diagram illustrating an example of total results of the number of observations for each path by mobile sensors.

FIG. 7 illustrates an example in which the edges $e_1$ and $e_3$ are identified as stationary sensor edges in the path graph 33 that includes the edges $e_1$, $e_2$, $e_3$, $e_4$, and $e_5$. In the example in FIG. 7, the stationary sensor edges are indicated by double lines. This is the same in the following diagrams. In this regard, among the edges included in the path graph 33, an edge other than the stationary sensor edges is hereinafter referred to as a "normal edge", and is illustrated by a solid line in the diagrams. Also, "$F(e_i)=X$" in FIG. 7 indicates that the number of observations of moving bodies observed by the stationary sensor in the stationary sensor edge $e_i$ is X.

Figure 9:
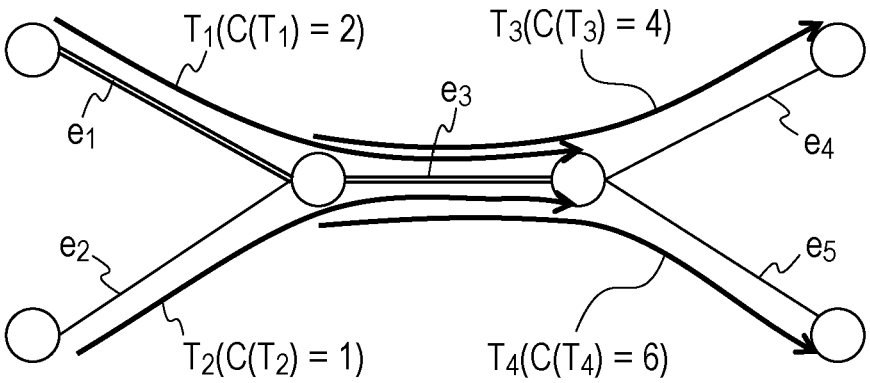
FIG. 9 is a diagram illustrating an example of total results of the number of observations for each path by mobile sensors.

Also, as illustrated in FIG. 8, the aggregation unit 14 sums up the number of observations for each path based on the path information transferred from the matching unit 13. In the example in FIG. 8, a path ID, which is the identification information of a path, is given for each path. Hereinafter a path having a path ID of $T_i$ is also denoted by a "path $T_i$". FIG. 9 illustrates an example of the total result of the number of observations for each path. The expression "$C(T_1)=X$" in FIG. 9 indicates that the number of observations of the path $T_i$ observed by the mobile sensor is X.

The aggregation unit 14 transfers the number of observations by the stationary sensors in the stationary sensor edges and the total result of the number of observations for each path by the mobile sensors to the expression creation unit 15.

The expression creation unit 15 creates an expression for estimating the observation rate by the mobile sensor for each path based on the total result transferred from the aggregation unit 14. The observation rate by the mobile sensor is indicated by the ratio of the number of observations by the mobile sensors to the actual traffic flow rate of each path included in the path graph 33. Specifically, the expression creation unit 15 creates an expression for estimating the observation rate for each path using the number of observations by the mobile sensors regarding the path and the number of observations at the stationary sensor edges included in the path.

Here, a description will be given of the reason for estimating the observation rate for each path for calculating the traffic flow rate.

For example, it is thought that the traffic flow rate for each edge is estimated by applying a technique for estimating the traveling time for each edge by multiplying the average speed of a vehicle transmitted from the road sensor and the average speed per hour of the vehicle that is transmitted from the running vehicle itself by $\alpha$ that is the actual distance of the road section indicated by the edge length or the edge. In this case, "the actual traffic flow rate for each edge"="the number of observations by the mobile sensors for each edge"÷"the observation rate by the mobile sensor in each edge", and thus the observation rate is equivalent to $\alpha$. However, the traffic flow rate of each edge is unknown, and thus the observation rate $\alpha$ of each edge by the mobile sensor is also unknown.

Thus, the average observation rate of the number of observations by a stationary sensor in a stationary sensor edge in which a correct traffic flow rate is observed is obtained from the number of observations by the mobile sensor in that stationary sensor edge. Assuming that the average observation rate is a, it is thought that the average observation rate is applied to each of all the edges.

Figure 10:
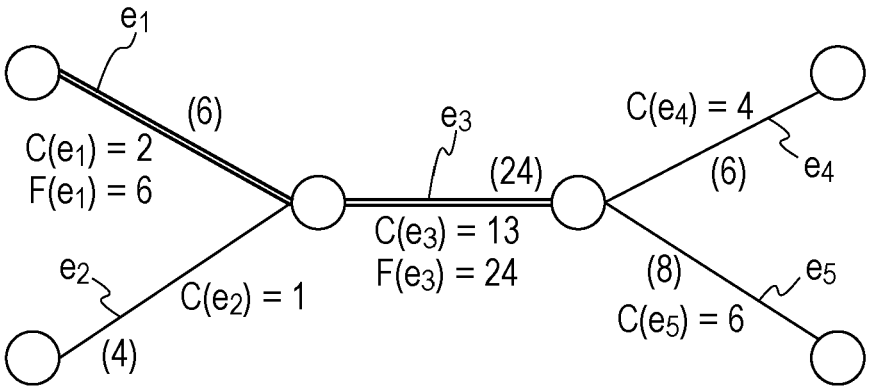
FIG. 10 is a diagram for explaining the case of applying a certain observation rate to each edge.

For example, as illustrated in FIG. 10, it is assumed that the number of observations ($C(e_i)$) by the mobile sensor is obtained for each of the edges $e_1$, $e_2$, $e_3$, $e_4$, and $e_5$, and the number of observations ($F(e_i)$) by the stationary sensor is obtained for each of the stationary sensor edges $e_1$ and $e_3$. Also, in FIG. 10, the number in parentheses, which is written with each edge, is the actual traffic flow rate for each edge that is illustrated for reference. In this case, it is possible to obtain the average observation rate $\alpha$ using the number of observations ($F(e_i)$) by the stationary sensors in the stationary sensor edges $e_1$ and $e_3$, and the number of observations ($C(e_i)$) by the mobile sensor as follows.

$$\alpha=\Sigma_{e_i \Sigma stationary\ sensor\ edge} C(e_i)/\Sigma_{e_i \Sigma stationary\ sensor\ edge} F(e_i)=(2+13)/(6+24)=0.5$$

By using $\alpha$ as the observation rate by the mobile sensor for each edge, it is possible to calculate the traffic flow rate for each edge as follows.

The traffic flow rate of the normal edge $e_2=1/\alpha=2$ (actually 4)

The traffic flow rate of the normal edge $e_4=4/\alpha=8$ (actually 6)

The traffic flow rate of the normal edge $e_5=6/\alpha=12$ (actually 8)

However, the traffic flow rate calculated by applying the average observation rate $\alpha$ to each edge sometimes has a large error with the actual traffic flow rate. This is because although the observation rate by a mobile sensor differs depending on the observation point, the observation rate for each edge is assumed to be a certain value ($\alpha$).

Thus, in the present embodiment, the reciprocal of the observation rate for the path $T_j$ observed by the mobile sensor is $\gamma_j$ which is used instead of the observation rate for each edge. A constraint satisfaction problem is formulated by using the number of observations by the stationary sensor as a constraint and $\gamma_j$ as a variable. Thereby, it is possible to express that the observation rate differs depending on the observation point, and the fact in which even one stationary sensor edge is included in the path becomes possible to be utilized as a constraint condition.

Also, a consideration is given to a method of solving an integer programming problem in which a constraint is the traffic flow rate observed by the stationary sensors and a variable is the traffic flow rate of the path having actual traffic results among the paths on a path graph. In this method, there is a problem of how to distribute the number of observations by the stationary sensors among the normal edges of a plurality of paths including the same stationary sensor edge.

Figure 11:
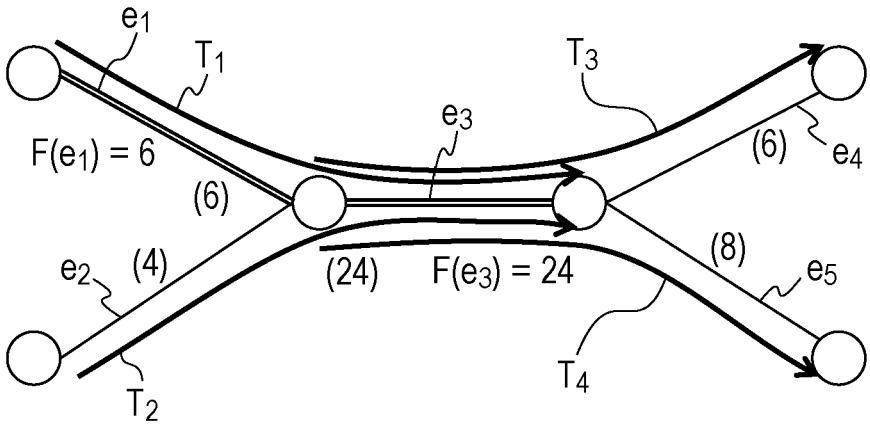
FIG. 11 is a diagram for explaining the case where only the number of observations by stationary sensors is used as a constraint condition.

For example, as illustrated in FIG. 11, it is assumed that a path $T_1(e_1, e_3)$, a path $T_2(e_2, e_3)$, a path $T_3(e_3, e_4)$, and a path $T_4(e_3, e_5)$ are paths having actual traffic results, and the stationary sensor edges are $e_1$ and $e_3$. Assuming that the traffic flow rates of the paths $T_1$, $T_2$, $T_3$, and $T_4$ are $\beta_1$, $\beta_2$, $\beta_3$, and $\beta_4$ respectively, the following relationship holds.

The traffic flow rate of the stationary sensor edge $e_1=\beta_1=6$

The traffic flow rate of the stationary sensor edge $e_3=\beta_1+\beta_2+\beta_3+\beta_4=24$ (The traffic flow rate of the normal edge $e_2=\beta_2$)

(The traffic flow rate of the normal edge $e_4=\beta_3$)

(The traffic flow rate of the normal edge $e_5=\beta_4$)

That is to say, a relationship of $\beta_2+\beta_3+\beta_4=18$ holds. As solutions that satisfy this relationship, it is possible to assign suitable integers to $\beta_2$, $\beta_3$, and $\beta_4$ respectively. However, there are many kinds of solutions that satisfy the relationship, and thus the possibility of allowing estimation of the actual traffic flow rate with high precision is low.

Thus, in the present embodiment, the number of observations for each path, which is obtained from mobile sensors, is added as a constraint condition. Thereby, for each of the normal edges included in a plurality of paths including the same stationary sensor edge, the solution is fixed by the constraint condition regarding the number of observations by the mobile sensors.

The expression creation unit 15 specifically assumes the reciprocal of the observation rate of the path t for any path t on the path graph 33 is $\gamma(t)$ ($\gamma(t)>1$). The expression creation unit 15 then formulates the constraint satisfaction problem as illustrated in the following Expression (1) under the constraint of the number of observations C(t) of each path t and the number of observations $F(e_j)$ of the stationary sensor edge. In this regard, $\{T_j\}$ is a set of paths that includes the stationary sensor edge $e_j$.

$$F(e_j)=\Sigma_{t\in\{Tj\}} C(t)\cdot\gamma(t) \tag{1}$$

Figure 12:
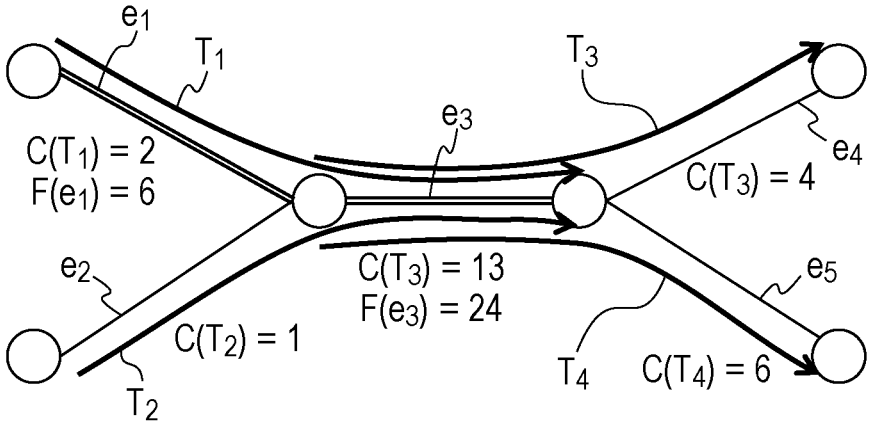
FIG. 12 is a diagram for explaining the case where the number of observations by stationary sensors and the number of observations for each path are used as a constraint condition.

The expression creation unit 15 creates, in accordance with Expression (1), an expression using the number of observations of the path including the stationary sensor edge for each stationary sensor edge. For example, as illustrated in FIG. 12, it is assumed that the number of observations $C(T_1)$ of the path $T_1(e_1, e_3)$ is 2, the number of observations $C(T_2)$ of $T_2(e_2, e_3)$ is 1, the number of observations $C(T_3)$ of $T_3(e_3, e_4)$ is 4, and the number of observations $C(T_4)$ of $T_4(e_3, e_5)$ is 6. Also, it is assumed that the number of observations $F(e_1)$ by the stationary sensor in the stationary sensor edge $e_1$ is 6, the number of observations $F(e_3)$ by the stationary sensor in the stationary sensor edge $e_3$ is 24. In this case, the expression creation unit 15 creates the following Expression (2) and Expression (3) in accordance with Expression (1).

$$F(e_1)=C(T_1)\cdot\gamma(T_1)\rightarrow 6=2\cdot\gamma(T_1) \tag{2}$$

$$F(e_3)=C(T_1)\cdot\gamma(T_1)+C(T_2)\cdot\gamma(T_2)+C(T_3)\cdot\gamma(T_3)+C(T_4)\cdot\gamma(T_4)\rightarrow 24=2\cdot\gamma(T_1)+1\cdot\gamma(T_2)+4\cdot\gamma(T_3)+6\cdot\gamma(T_4) \tag{3}$$

The expression creation unit 15 transfers the created expressions to the calculation unit 16.

The calculation unit 16 multiplies $\gamma(t)$ by C(t) to calculate the traffic flow rate for each path t. $\gamma(t)$ is the reciprocal of the observation rate for each path t and the solution of the expression transferred from the expression creation unit 15, and C(t) is the number of observations of the path t observed by the mobile sensor. It is possible to use a solver of an existing linear programming, or the like for this calculation.

For example, when the calculation unit 16 receives the above-described Expression (2) and Expression (3) from the expression creation unit 15, the calculation unit 16 obtains $\gamma(T_1)=3$ from Expression (2) so as to derive the following Expression (4).

$$18=1\cdot\gamma(T_2)+4\cdot\gamma(T_3)+6\cdot\gamma(T_4) \tag{4}$$

For example, assuming that the traffic flow rate of the path $T_j$ is $E_j$, the expression creation unit 15 calculates the following candidate values of the traffic flow rate by solving the above-described Expression (4) using a solver. In this regard, from Expression (2), $E_1=6$.

($E_2$, $E_3$, $E_4$)=(2, 5, 11), (2, 6, 10), (2, 7, 9), (2, 8, 8), (2, 9, 7), (3, 5, 10), (3, 6, 9), (3, 7, 8), (3, 8, 7), (4, 5, 9), (4, 6, 8), (4, 7, 7), (5, 5, 8), (5, 6, 7), (6, 5, 7)

These solutions are values calculated with higher precision than in the case of applying a certain observation rate for each edge. Also, the above-described solution is guaranteed to be a subset of the solution by the method described using FIG. 11, and thus it is possible to calculate the traffic flow rate with higher precision than the method described using FIG. 11.

The calculation unit 16 selects the traffic flow rate for each path, for example at random from the above-described candidate values, and transfers the traffic flow rate for each path to the display control unit 17.

Figure 13:
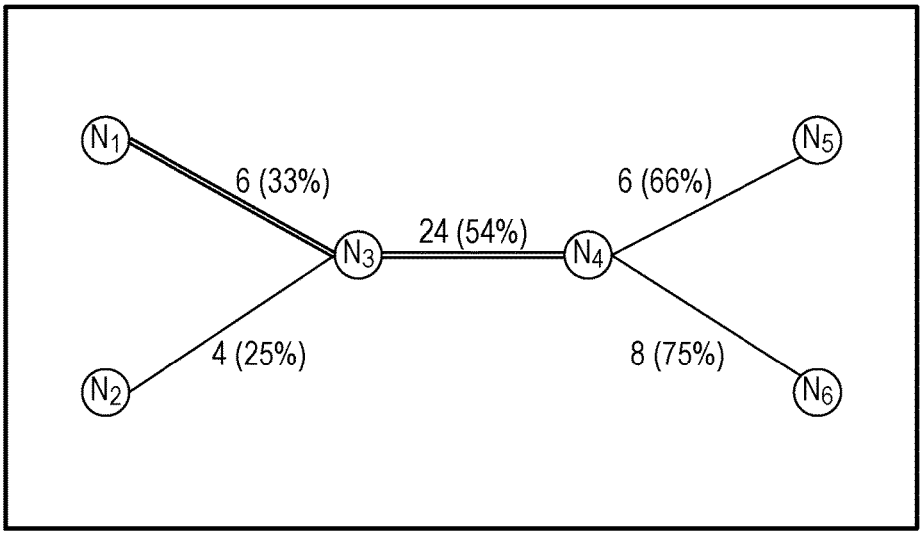
FIG. 13 is a diagram illustrating an example of a calculation result screen.

The display control unit 17 controls the display device 20 so as to display the calculation result screen in which the calculated traffic flow rate for each path is superimposed on the path graph 33, for example as illustrated in FIG. 13. In this regard, the paths on the path graph 33 include a path including only one edge, and FIG. 13 is the example in which the traffic flow rate is calculated for the path including only the one edge. Also, the display control unit 17 may display the observation rate for each path with the traffic flow rate for each path. The observation rate for each path is obtained as the reciprocal of $\gamma(t)$ that is the solution of the expression created by the expression creation unit 15.

Figure 14:
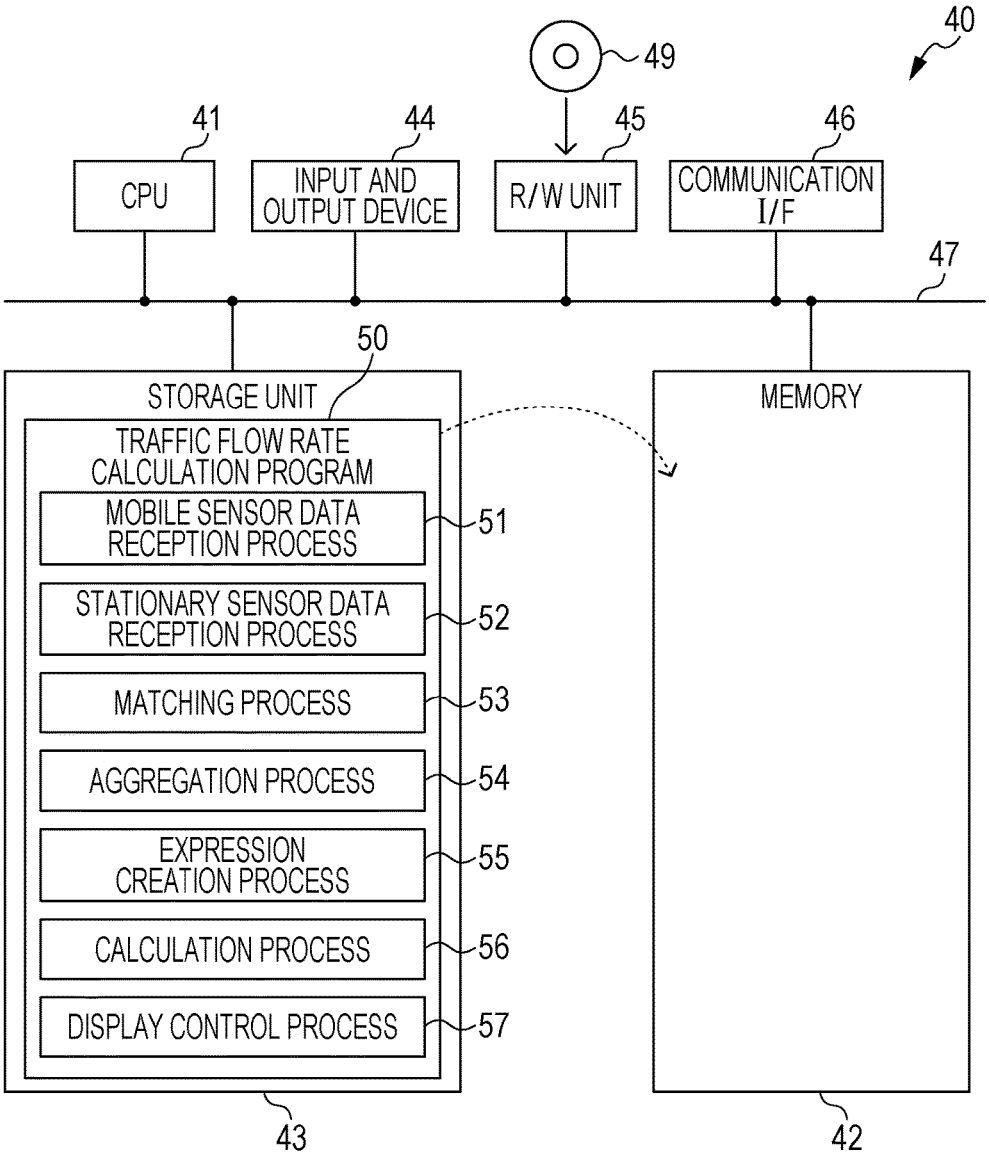
FIG. 14 is a block diagram illustrating a schematic configuration of a computer that functions as the traffic flow rate calculation device according to the present embodiment.

It is possible to realize the traffic flow rate calculation device 10 by a computer 40 illustrated in FIG. 14, for example. The computer 40 includes a processor or CPU 41, a memory 42 as a temporary storage area, and a nonvolatile storage unit 43. Also, the computer 40 includes an input and output device 44 including a display device 20, a read/write (R/W) unit 45 that controls reading data from and writing data to the recording medium 49, and a communication interface (I/F) 46. The processor or CPU 41, the memory 42, the storage unit 43, the input and output device 44, the R/W unit 45, and the communication I/F 46 are mutually coupled via a bus 47.

It is possible to realize the storage unit 43 by a hard disk drive (HDD), a solid state drive (SSD), a flash memory, or the like. In the storage unit 43 as a storage medium, a traffic flow rate calculation program 50 for functioning the computer 40 as the traffic flow rate calculation device 10 is stored. The traffic flow rate calculation program 50 includes a mobile sensor data reception process 51, a stationary sensor data reception process 52, a matching process 53, an aggregation process 54, an expression creation process 55, a calculation process 56, and a display control process 57.

The processor or CPU 41 reads the traffic flow rate calculation program 50 from the storage unit 43 and loads the program into the memory 42, and executes the processes of the traffic flow rate calculation program 50 in sequence. The processor or CPU 41 executes the mobile sensor data reception process 51 so as to operate as the mobile sensor data reception unit 11 illustrated in FIG. 1. Also, the processor or CPU 41 executes the stationary sensor data reception process 52 so as to operate as the stationary sensor data reception unit 12 illustrated in FIG. 1. Also, the processor or CPU 41 executes the matching process 53 so as to operate as the matching unit 13 illustrated in FIG. 1. Also, the processor or CPU 41 executes the aggregation process 54 so as to operate as the aggregation unit 14 illustrated in FIG. 1. Also, the processor or CPU 41 executes the expression creation process 55 so as to operate as the expression creation unit 15 illustrated in FIG. 1. Also, the processor or CPU 41 executes the calculation process 56 so as to operate as the calculation unit 16 illustrated in FIG. 1. Also, the processor or CPU 41 executes the display control process 57 so as to operate as the display control unit 17 illustrated in FIG. 1. Thereby, the computer 40 that has executed the traffic flow rate calculation program 50 functions as the traffic flow rate calculation device 10.

In this regard, it is possible to realize the functions that are realized by the traffic flow rate calculation program 50 by, for example a semiconductor integrated circuit, more specifically an application specific integrated circuit (ASIC), or the like.

Next, a description will be given of the operation of the traffic flow rate calculation device 10 according to the present embodiment. The traffic flow rate calculation device 10 performs the traffic flow rate calculation processing illustrated in FIG. 15.

First, in step S10, the mobile sensor data reception unit 11 receives the mobile sensor data 31, and transfers the received mobile sensor data 31 to the matching unit 13. Also, the stationary sensor data reception unit 12 receives the stationary sensor data 32, and transfers the received stationary sensor data 32 to the aggregation unit 14.

Next, in step S20, the matching unit 13 reads the path graph 33, and performs matching of the trajectory indicated by each of the mobile sensor data 31 with the path graph 33 so as to calculate the path corresponding to the trajectory.

Next, in step S30, the aggregation unit 14 identifies a stationary sensor edge based on the stationary sensor data 32 transferred from the stationary sensor data reception unit 12, and sums up the number of observations of the moving bodies observed by the stationary sensor corresponding to the stationary sensor edge. Also, the aggregation unit 14 sums up the number of observations for each path on the path graph 33 based on the path information transferred from the matching unit 13.

Figure 16:
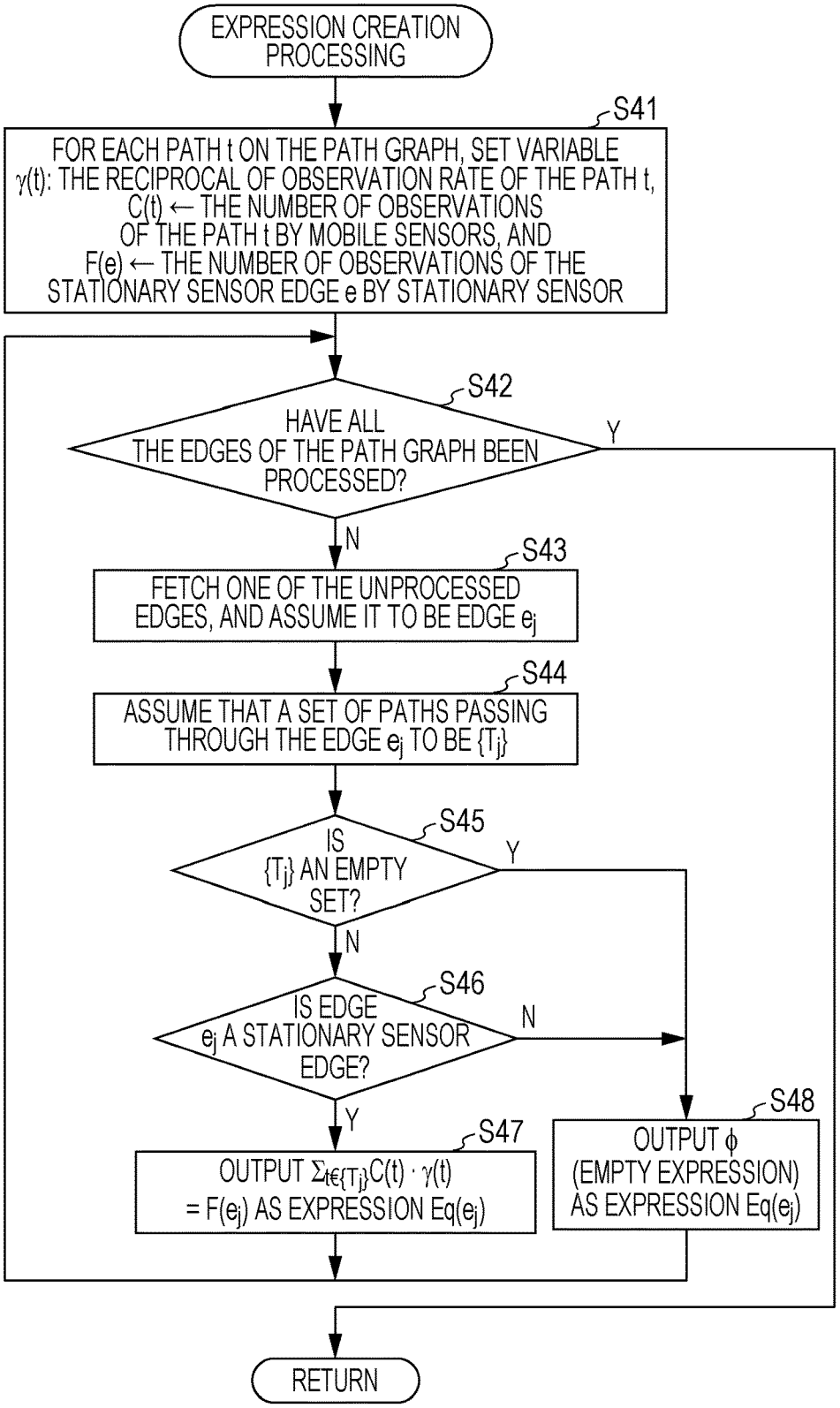
FIG. 16 is a flowchart illustrating an example of expression creation processing.

Next, in step S40, the expression creation processing, the details of which is illustrated in FIG. 16, is performed.

In step S41 of the expression creation processing illustrated in FIG. 16, the expression creation unit 15 sets the variable $\gamma(t)$ of the reciprocal of the observation rate of the path t for each path t on the path graph 33. Also, the expression creation unit 15 sets the number of observations of the path t by the mobile sensor, which has been summed up in step S30 to C(t), and sets the number of observations of the stationary sensor edge e by the stationary sensor to F(e).

Next, in step S42, the expression creation unit 15 determines whether or not the processing of the steps S43 to S48 illustrated below has completed for all the edges included in the path graph 33. When there is an unprocessed edge, the processing proceeds to step S43, the expression creation unit 15 fetches one of the unprocessed edges, and sets the unprocessed edge to the processing target edge $e_j$.

Next, in step S44, the expression creation unit 15 obtains a set of paths that pass through the edge $e_j$ as $\{T_j\}$.

Next, in step S45, the expression creation unit 15 determines whether or not $\{T_j\}$ is an empty set. When $\{T_j\}$ is not an empty set, the processing proceeds to step S46, whereas when $\{T_j\}$ is an empty set, the processing proceeds to step S48.

In step S46, the expression creation unit 15 determines whether or not the edge $e_j$ is a stationary sensor edge. When the edge $e_j$ is a stationary sensor edge, the processing proceeds to step S47, whereas when the edge $e_j$ is a normal edge, the processing proceeds to step S48.

In step S47, the expression creation unit 15 creates an expression in accordance with Expression (1) as the expression $Eq(e_j)$ for the edge $e_j$. Specifically, the expression creation unit 15 creates an expression in which the reciprocal of the observation rate of each path t ($t \in \{T_j\}$) is used as the variable $\gamma(t)$ using the number of observations C(t) of each path t ($t \in \{T_j\}$) included in the number of observations $F(e_j)$ of the stationary sensor edge $e_j$, and the set $\{T_j\}$. The expression creation unit 15 outputs the created expression to the calculation unit 16, and the processing returns to step S42.

On the other hand, in step S48, the expression creation unit 15 outputs an empty expression to the calculation unit 16 as the expression $Eq(e_j)$ for the edge $e_j$, and the processing returns to step S42.

Figure 15:
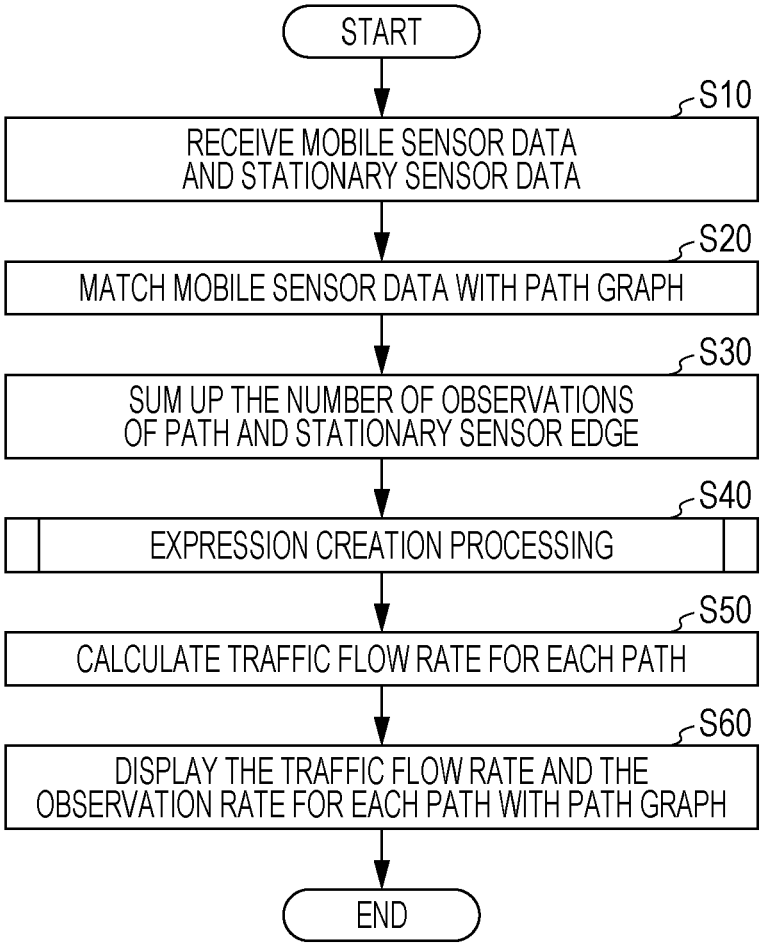
FIG. 15 is a flowchart illustrating an example of traffic flow rate calculation processing according to the present embodiment.

In step S42, when the expression creation unit 15 determines that the processing of steps S43 to S48 has completed for all the edges included in the path graph 33, the processing returns to the traffic flow rate calculation processing illustrated in FIG. 15.

Next, in step S50 of the traffic flow rate calculation processing illustrated in FIG. 15, the calculation unit 16 multiplies the reciprocal $\gamma(t)$ of the observation rate for each path t, which is the solution of the expression created by expression creation unit 15, with the number of observations C(t) of the path t observed by the mobile sensor, to calculate the candidate values of the traffic flow rate for each path t. The calculation unit 16 then selects the traffic flow rate for each path from the candidate values, for example at random, and transfers the traffic flow rate to the display control unit 17.

Next, in step S60, the display control unit 17 controls the display device 20, for example as illustrated in FIG. 13, so that a calculation result screen in which the calculated traffic flow rate for each path and the observation rate is displayed in a superimposed manner on the path graph 33, and the traffic flow rate calculation processing is terminated.

As described above, with the traffic flow rate calculation device according to the present embodiment, the observation rate of the path included in a path graph is estimated using the number of observations of the stationary sensor edge sensor included in the path and the number of observations of the path. The traffic flow rate for each path is then calculated using the estimated observation rate for each path. Thereby, it is possible to calculate the traffic flow rate for each path with higher precision than the case of applying a certain observation rate to each edge, and the case of using only the number of observations of the stationary sensor edge as a constraint condition.

In this regard, in the above-described embodiment, a description has been given of the case of solving the constraint satisfaction problem of Expression (1) having the observation rate for each path as a variable. However, the expression for estimating the observation rate for each path is not limited to Expression (1). For example, when there are no big difference among the observation rates by the mobile sensor at each point, a constraint condition such as minimizing the difference between the maximum value and the minimum value of the observation rate for each path may be further added.

Also, when there is a path not including a stationary sensor edge in a path graph, the traffic flow rate of a path including a stationary sensor edge is calculated in advance. The calculated traffic flow rate of the path ought to be used as the number of observations of the stationary sensor edge, and the traffic flow rate of the path not including the stationary sensor edge and including the path having the calculated traffic flow rate ought to be calculated.

Also, in the above-described embodiment, a description has been given of the case of using a path graph expressed in a plane graph as an example of a road network. However, the present embodiment is not limited to this. The road network may be expressed by a graph having edges that mutually intersect, or may be expressed in a three or more dimensional graph.

In this regard, in the above-described embodiment, a description has been given of mode in which the traffic flow rate calculation program 50 is stored (installed) in the storage unit 43 in advance. However, the present embodiment is not limited to this. It is possible to provide the traffic flow rate calculation program according to the present embodiment in a mode of being recorded on a recording medium, such as a CD-ROM, a DVD-ROM, a USB memory, or the like.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A traffic flow rate calculation method, comprising:

utilizing mobile sensors provided on moving bodies which move in a road network including a plurality of nodes which represent positional information of a road system of the road network and a plurality of edges which couple between the nodes and configured to measure movement trajectories of the moving bodies, and a stationary sensor provided at one or more edges of the plurality of edges and configured to measure the moving bodies which pass locations corresponding to the one or more edges;

obtaining, from the mobile sensors, for each path including at least one edge of the plurality of edges, a first number of observations being a number of movement trajectories measured at the corresponding path by the mobile sensors;

obtaining, from the stationary sensor, for the each path, a second number of observations being a number of moving bodies which pass one or more locations, which are included in the locations corresponding to the one or more edges and in the corresponding path, and measured by the stationary sensor;

setting, by a processor, an observation rate for the each path represented by a ratio of the first number of observations to an actual traffic flow rate of the corresponding path as a variable;

estimating, when the corresponding path includes at least one of the locations corresponding to the one or more edges, the observation rate for the each path as a solution of an equation describing the second number of observations is equal to a sum of products of the variable and the first number of observations for the each path;

estimating, when the corresponding path does not include at least one of the locations corresponding to the one or more edges, the observation rate for the each path by using, as the second number of observations, a traffic flow rate calculated based on the observation rate of the path including at least one of the locations corresponding to the one or more edges; and calculating a traffic flow rate for the each path by using the estimated observation rate for the each path and the first number of observations for the each path.

2. The traffic flow rate calculation method according to claim 1, wherein the observation rate for the each path is estimated by solving a constraint satisfaction problem having the first number of observations for the each path and the second number of observations for the each path as constraint conditions.

3. The traffic flow rate calculation method according to claim 2, wherein a constraint condition of minimizing a difference between a maximum value and a minimum value of the estimated observation rate for the each path is added to the constraint satisfaction problem.

4. The traffic flow rate calculation method according to claim 1, further comprising processing for performing control so as to cause the computer to display the calculated traffic flow rate for the each path in association with the road network on a display device.

5. The traffic flow rate calculation method according to claim 4, wherein the processing for performing control includes displaying the observation rate for the each path, used for calculating the traffic flow rate, with the traffic flow rate for the each path on the display device.

6. A traffic flow rate calculation device comprising:

a memory; and a processor coupled to the memory and the processor configured to, utilize mobile sensors provided on moving bodies which move in a road network including a plurality of nodes which represent positional information of a road system of the road network and a plurality of edges which couple between the nodes and configured to measure movement trajectories of the moving bodies, and a stationary sensor provided at one or more edges of the plurality of edges and configured to measure the moving bodies which pass locations corresponding to the one or more edges;

obtain, from the mobile sensors, for each path including at least one edge of the plurality of edges, a first number of observations being a number of movement trajectories measured at the corresponding path by the mobile sensors;

obtain, from the stationary sensor, for the each path, a second number of observations being number of moving bodies which pass one or more locations, which are included in the locations corresponding to the one or more edges and in the corresponding path, and measured by the stationary sensor;

set an observation rate for the each path represented by a ratio of the first number of observations to an actual traffic flow rate of the corresponding path as a variable;

estimate, when the corresponding path includes at least one of the locations corresponding to the one or more edges, the observation rate for the each path as a solution of an equation describing the second number of observations is equal to a sum of products of the variable and the first number of observations for the each path;

estimate, when the corresponding path does not include at least one of the locations corresponding to the one or more edges, the observation rate for the each path by using, as the second number of observations, a traffic flow rate calculated based on the observation rate of the path including at least one of the locations corresponding to the one or more edges; and calculate a traffic flow rate for the each path by using the estimated observation rate for the each path and the first number of observations for the each path.

7. The traffic flow rate calculation device according to claim 6, wherein the processor estimates the observation rate for the each path by solving a constraint satisfaction problem having the first number of observations for the each path and the second number of observations for the each path as constraint conditions.

8. The traffic flow rate calculation device according to claim 7, wherein the processor adds a constraint condition of minimizing a difference between a maximum value and a minimum value of the estimated observation rate for the each path to the constraint satisfaction problem.

9. The traffic flow rate calculation device according to claim 6, further comprising a display control unit for performing control so as to display the traffic flow rate calculated by the calculation unit for the each path in association with the road network on a display device.

10. The traffic flow rate calculation device according to claim 9, wherein the display control unit performs control so as to display the observation rate for the each path, used for calculating the traffic flow rate, with the traffic flow rate for the each path on the display device.

11. A non-transitory computer-readable recording medium having stored therein a program that causes a computer to execute a process, the process comprising:

utilizing mobile sensors provided on moving bodies which move in a road network including a plurality of nodes and a plurality of edges which couple between the nodes and configured to measure movement trajectories of the moving bodies, and a stationary sensor provided at one or more edges of the plurality of edges and configured to measure the moving bodies which pass locations corresponding to the one or more edges;

obtaining, from the mobile sensors, for each path including at least one edge of the plurality of edges, a first number of observations being a number of movement trajectories measured at the corresponding path by the mobile sensors;

obtaining, from the stationary sensor, for the each path, a second number of observations being a number of moving bodies which pass one or more locations, which are included in the locations corresponding to the one or more edges and in the corresponding path, and measured by the stationary sensor;

setting an observation rate for the each path represented by a ratio of the first number of observations to an actual traffic flow rate of the corresponding path as a variable;

estimating, when the corresponding path includes at least one of the locations corresponding to the one or more edges, the observation rate for the each path as a solution of an equation describing the second number of observations is equal to a sum of products of the variable and the first number of observations for the each path;

estimating, when the corresponding path does not include at least one of the locations corresponding to the one or more edges, the observation rate for the each path by using, as the second number of observations, a traffic flow rate calculated based on the observation rate of the path including at least one of the locations corresponding to the one or more edges; and calculating a traffic flow rate for the each path by using the estimated observation rate for the each path and the first number of observations for the each path.

12. The non-transitory computer-readable recording medium having stored therein a program that causes a computer to execute a process according to claim 11, wherein the observation rate for the each path is estimated by solving a constraint satisfaction problem having the first number of observations for the each path and the second number of observations for the each path as constraint conditions.

13. The non-transitory computer-readable recording medium having stored therein a program that causes a computer to execute a process according to claim 12, wherein a constraint condition of minimizing a difference between a maximum value and a minimum value of the estimated observation rate for the each path is added to the constraint satisfaction problem.

14. The non-transitory computer-readable recording medium having stored therein a program that causes a computer to execute a process according to claim 11, further comprising processing for performing control so as to cause the computer to display the calculated traffic flow rate for each path in association with the road network on a display device.

* * * * *